US008939704B2

(12) United States Patent
Winkes

(10) Patent No.: US 8,939,704 B2
(45) Date of Patent: Jan. 27, 2015

(54) METHOD FOR OPERATING A MULTISTAGE COMPRESSOR

(75) Inventor: Georg Winkes, Kaarst (DE)

(73) Assignee: Siemens Aktiengesellschaft, München (DE)

( * ) Notice: Subject to any disclaimer, the term of this patent is extended or adjusted under 35 U.S.C. 154(b) by 749 days.

(21) Appl. No.: 13/130,619

(22) PCT Filed: Nov. 23, 2009

(86) PCT No.: PCT/EP2009/065613

§ 371 (c)(1),
(2), (4) Date: May 23, 2011

(87) PCT Pub. No.: WO2010/058002

PCT Pub. Date: May 27, 2010

(65) Prior Publication Data

US 2011/0229303 A1 Sep. 22, 2011

(30) Foreign Application Priority Data

Nov. 24, 2008 (DE) ..... 10 2008 058 799

(51) Int. Cl.

| | |
|---|---|
| ***F04D 27/02*** | (2006.01) |
| ***F04D 19/02*** | (2006.01) |
| ***F04D 29/58*** | (2006.01) |
| ***F04D 27/00*** | (2006.01) |

(52) U.S. Cl.

CPC ..... *F04D 27/001* (2013.01); *F04D 19/02* (2013.01); *F04D 29/5826* (2013.01)

USPC ..... 415/1; 415/17; 416/1; 416/36

(58) Field of Classification Search

USPC ..... 415/1, 16, 17, 26, 47, 118; 416/1, 35, 416/36, 61

See application file for complete search history.

(56) References Cited

U.S. PATENT DOCUMENTS

| | | | | |
|---|---|---|---|---|
| 4,298,310 | A * | 11/1981 | Blotenberg | 415/1 |
| 4,608,833 | A * | 9/1986 | Kountz | 62/228.1 |
| 4,770,602 | A * | 9/1988 | Miura et al. | 415/29 |
| 4,807,150 | A * | 2/1989 | Hobbs | 702/47 |

(Continued)

FOREIGN PATENT DOCUMENTS

| | | | |
|---|---|---|---|
| CN | 100388528 | C | 5/2008 |
| DE | 2730789 | C2 | 1/1979 |

(Continued)

OTHER PUBLICATIONS

Staroselsky at al., Protecting Multicase compressors, Hydrocarbon Processing, Mar. 1, 1990, pp. 85-89, vol. 69, No. 3, XP 000137751, ISSN: 0018-8190, Gulf Publishing Co, Houston, US.

(Continued)

*Primary Examiner* — Edward Look
*Assistant Examiner* — Christopher R Legendre

(57) ABSTRACT

A method for operating a multistage compressor is provided. The method includes monitoring the pump limit, wherein at least a first measurement parameter measured during operation is compared to a reference parameter. The reference parameter is characteristic of reaching the surge limit or a specific distance of the operating point from the surge limit. A multistage compressor is also provided. In order to enlarge the operating range without risking safety, it is proposed that each stage to be monitored individually for the onset of the surge.

1 Claim, 2 Drawing Sheets

(56) References Cited

U.S. PATENT DOCUMENTS

| | | | | |
|---|---|---|---|---|
| 4,825,380 | A | 4/1989 | Hobbs | |
| 5,290,142 | A * | 3/1994 | Ispas et al. | 415/1 |
| 5,508,943 | A * | 4/1996 | Batson et al. | 700/287 |
| 5,894,736 | A * | 4/1999 | Beaverson et al. | 62/230 |
| 6,164,901 | A | 12/2000 | Blotenberg | |
| 7,025,558 | B2 * | 4/2006 | Blotenberg | 415/1 |
| 7,094,019 | B1 * | 8/2006 | Shapiro | 415/27 |
| 7,108,477 | B2 * | 9/2006 | Grauer | 415/1 |
| 8,087,870 | B2 * | 1/2012 | Flucker et al. | 415/1 |
| 2008/0264067 | A1 * | 10/2008 | Flucker et al. | 60/793 |
| 2011/0229303 | A1 * | 9/2011 | Winkes | 415/1 |

FOREIGN PATENT DOCUMENTS

| | | | | |
|---|---|---|---|---|
| DE | 4202226 | C2 | 4/1993 | |
| DE | 4316202 | C2 | 11/1994 | |
| DE | 19828368 | A1 | 1/2000 | |
| EP | 0366 219 | A2 | 5/1990 | |
| EP | 0366219 | A2 | 5/1990 | |
| EP | 0769624 | A1 | 4/1997 | |
| EP | 0967396 | A2 | 12/1999 | |
| EP | 1474610 | B1 | 5/2006 | |
| EP | 1985862 | A1 | 10/2008 | |
| JP | 57046088 | A * | 3/1982 | F04D 27/02 |
| JP | 2005146927 | A | 6/2005 | |
| WO | WO 03038282 | A1 | 5/2003 | |
| WO | WO 2009133017 | A1 * | 11/2009 | |

OTHER PUBLICATIONS

Staroselsky et al: "Protecting Multicase Compressors"; Hydrocarbon Processing, Gulf Publishing Co; Bd. 69; Nr. 3; pp. 85-89; XP000137751; ISSN; 0018-8190; 1990; US; Mar. 1, 1990.

"Compressors"; Society of Petroleum Engineers; URL: http://petrowiki.org/Compressors#Polytropic_head; pp. 1-11; XP055139687; 2013; Sep. 17, 2013

Rasmussen P. C. et al; "Centrifugal Compressor Applications-Upstream and Midstream"; URL: http://turbolab.tamu.edu/proc/turboproc/T38/ch16_Rasmussen.pdf; pp. 169-186; XP055139676; 2009; Jan. 1, 2009.

* cited by examiner p1, p2, p3, p4/TCO/ T
vario
EV4
PIC
Pi-Algorithm
SLC1
min
SLC4
SLC3
SLC2
IC4
SLCV
ST4
pi4
IC3
ST3
PO
IGV2
pi3
IC2
ST2
IC1
ST1
IGV1
pi2
pi1
PF
EV3
Dev.
EV2
EV1
CP1
CP2
CO
5

METHOD FOR OPERATING A MULTISTAGE COMPRESSOR

CROSS REFERENCE TO RELATED APPLICATIONS

This application is the U.S. National Stage of International Application No. PCT/EP2009/065613, filed Nov. 23, 2009 and claims the benefit thereof. The International Application claims the benefits of Gelman application No. 10 2008 058 799.0 DE filed Nov. 24, 2008. All of the applications are incorporated by reference herein in their entirety.

FIELD OF INVENTION

The invention relates to a method for operating a multistage compressor with a monitoring means for the surge limit, in which method at least one first measured variable which is measured during operation is compared with a reference variable, which reference variable is characteristic of the reaching of the surge limit or a defined gap from the operating point from the surge limit. In addition, the invention relates to a multistage compressor having an evaluation module for monitoring the reaching of the surge limit or of a defined gap from the surge limit with a measuring apparatus for detecting a first measured variable during operation, which evaluation module is configured in such a way that it compares the first measured variable with a reference variable, which reference variable is characteristic of the reaching of the surge limit or a defined gap from the surge limit.

BACKGROUND OF INVENTION

The surge limit of a compressor denotes a transition from an aerodynamically stable to an aerodynamically unstable operating mode, stability being understood as meaning the flowing of a process fluid in the provided flow direction. Considerable backflows occur with the start of the surging in a compressor, which backflows cause pressure fluctuations and temperature increases which already lead to damage after a comparatively short operating duration in this state. The reaching of the surge limit can be discerned clearly, even for an inexperienced operator, since the pressure fluctuations cause considerable oscillations, the noise of which exceeds the level of usual operation.

The operation of a turbocompressor therefore requires measures which avoid the reaching of the surge limit and restrict the state of surging to time periods which are as short as possible.

Accordingly, the regulator of a compressor always keeps a defined safety gap from a surge limit of the operating map. In addition, a surge limit regulating valve is provided as a rule which makes it possible to lower the pressure at the outlet of the turbocompressor if a defined gap from the surge limit is undershot or surging has already started. The state of surging or a tight closeness to the surge limit is characterized by a reduced mass throughput, mass flow or volumetric flow of the process gas to be delivered and with a corresponding pressure ratio over the compressor.

Conventional strategies for monitoring the surge limit or avoiding surging have already been described in DE 27 30 789 C2, DE 42 02 226 C2 or DE 43 16 202 C2. The methods there provide, for example, for an inlet pressure to be set in a ratio to an output pressure of a multistage compressor, and optionally for a volumetric flow and a temperature of the process gas also to be recorded along the compression path, preferably after intercooling, and for said measured variables for determining a surge limit of the machine to form the basis for the current operating point.

Experience shows, however, that determinations of this type are imprecise and these conventional monitoring methods require a comparatively great safety gap from the surge limit, which safety gap unfavorably restricts the available operating range of the turbocompressor. If this safety range is reduced, high loadings of the turbocompressor as a consequence of surging occur in certain operating states, with the result that the mechanical integrity is endangered.

SUMMARY OF INVENTION

The invention has therefore made it its object to improve a method of the type mentioned in the introduction, in such a way that the operating range of the turbocompressor is enlarged, without the safety against surging being impaired.

The inventive solution to the object proposes a method for operating a turbocompressor of the type mentioned in the introduction, in which method the characterizing features of the main claim are additionally provided. In addition, a multistage compressor of the type mentioned in the introduction having the additional features found in the claims is proposed. The subclaims which refer back in each case contain advantageous developments.

In the vocabulary of this patent application, the word "stage" means one or more compressor stages, no intercooling being provided within the stage. Intercooling can be provided at the inlet or outlet of the stage. The stage according to the invention is a compression section, that is to say an increase in pressure and/or density, which is not interrupted by intercooling.

The position of the surge limit of intercooled compressors is determined clearly by, for example, suction pressure, suction temperature, recooling temperatures and the positions of adjustable inlet guide vane apparatuses. Other parameter constellations are likewise suitable for clearly determining the position of the surge limit.

As a rule, compressors of the generic type have a single surge limit regulating valve which is actuated by a surge limit regulator which in previous practice has dispensed with the detection of the recooling temperatures and the positions of the guide vane apparatuses. A relationship between final pressure of a surge limit and delivery quantity is usually stored in the form of a regulating line for the surge limit regulating valve. A temperature correction is sometimes provided based on theoretical prognoses via the change of the overall machine surge limit at different suction temperatures.

The advantages of the invention can be summarized quickly if examples of concrete operation of a turbocompressor are considered.

In FIG. 1, to this end, in each case one operating point OP1, OP2 is illustrated diagrammatically using the example of a four-stage compressor with adjustable inlet guide vane apparatuses IGV1, IGV3 in front of a first stage 1 and a third stage 2. Four stages ST1, ST2, ST3, ST4 of a multistage compressor 5, of which the first stage 1 and the third stage 3 in each case have an inlet guide vane apparatus IGV1, IGV3, are flowed through one after another by a process fluid PF with pressure increase $\Delta p1$, $\Delta p2$, $\Delta p3$, $\Delta p4$. The characteristic diagrams of the stages are outlined in four diagrams D1, D2, D3, D4, a first variable $f(\dot{V})$ which correlates with a volumetric flow $\dot{V}$ being plotted on the abscissa, and a second variable $f(\Delta pi)$ which correlates with the pressure increase being plotted on the ordinate. The stages ST1, ST3 are in each case equipped with an inlet guide vane apparatus IGV1, IGV3 and have a characteristic diagram comprising at least one operating line OPL1-OPL4 with a dependency on the angle of attack α of the inlet guide vane apparatus IGV1, IGV3, whereas those stages without an inlet guide vane apparatus IGV1, IGV3 have only one characteristic diagram in the form of a single operating line OPL1-OPL5. In each case one intercooler IC1, IC2, IC3, IC4 is provided between the stages ST1-ST4 and behind the final stage ST4, by means of which intercooler IC1, IC2, IC3, IC4 the process gas is cooled in a thermal exchange with a cooling medium CF. At the end with the lowest volumetric flow $\dot{V}$ and the highest pressure of the respective operating lines OPL1-OPL4, the latter are ended by the surge limit SL or surge limit line. Here, by way of example, a first defined operating point OP1 is shown in each of the diagrams D1, D2, D3, D4, which operating point OPL1 occurs at a defined temperature TCO of the cooling medium CF for the cooling of the intercoolers IC1, IC2, IC3, IC4 which are situated between the individual stages 1 to 4. At the operating point OP1 which is shown, the surge limit SL is reached in the first stage ST1. There is still a sufficient gap from the surge limit in the remaining stages under these operating conditions.

The same arrangement with the same position of the inlet guide vane apparatuses IGV1, IGV3 but with a lower cooling water temperature TCO is shown at a second operating point OP2, with the result that the suction temperatures of the stages which follow after the first stages are lower than in the preceding example. Under these conditions, the third stage 3 then determines the position of the surge limit SL.

Similar effects are produced if, for example, the cooler is contaminated in the intercooler IC1-IC4 between the third and the fourth stage and the recooling temperature in front of the last stage becomes higher or the position of the, for example, second guide vane apparatus IGV1, IGV3 deviates from the setpoint position.

The invention avoids effects of this type by the individual consideration of each individual stage with respect to the reaching of the surge limit, and accordingly optimizes the utilization of the actually possible operating range without increasing the risk of surging. It is even shown that the stage-specific monitoring according to the invention affords greater safety against surging.

The pressure in front of the respective stage is expediently measured as first measured variable. The temperature in front of the stage can be determined as second measured variable, which increases the accuracy of the localization of the surge limit. One particularly favorable embodiment of the invention provides for the volumetric flow, mass throughput or mass flow of the process fluid to be measured only once along the flow path, preferably at the inlet of the turbocompressor. Greater accuracy and improved utilization of the operating range can be achieved if this measurement, which regularly takes place as a pressure differential measurement across a restrictor, is provided at the inlet or outlet of each stage.

One advantageous development of the invention provides for each stage to be assigned a dedicated regulating line which delimits an operating range, in which the compressor is operated without surging, at a gap on this side from the surge limit. In an analogous manner to the regulating line, a control line for controlling the opening of a bypass valve or a regulating line for controlling the surge limit regulating valve can be assigned to each stage.

The control line and/or the regulating line can expediently be represented as a plot of a relationship between a volumetric flow or a dimensionless equivalent and the pressure number or a pressure-related equivalent; the regulating line and/or pressure line are/is fixed by a gap from the surge limit by a ratio of greater than 1 of the measured volumetric flow or of the dimensionless equivalent to that of the surge limit or a ratio of less than 1 of the measured pressure number without the pressure-related equivalent to the corresponding value of the surge limit. The advantage of the regulating line as a function of dimensionless equivalents lies in the applicability to different operating states. In the case of a selection between different dimensionless characteristic variables, in which the regulating line for the surge limit regulating valve is present, it is expedient if the method according to the invention uses that characteristic variable which results in the greatest operating range in the case of a defined safety gap from the surge limit. If, for example, the characteristic diagram has operating lines with a particularly pronounced dependency on the pressure or a dimensionless pressure number, it is expedient to also use them as a criterion for the regulation of the surge limit regulating valve instead of a characteristic variable which is related to volumetric flow, since this results in the greater operating range of the machine.

An additional increase in safety results if, in addition to the criterion with the most pronounced influence on the change in the operating lines of the characteristic diagram, a second criterion with a smaller influence on the operating lines but based on a small gap from the surge limit is additionally the basis for the regulation of the opening position of the surge limit regulating valve. Should there be an error in the use of the first criterion, surging is still suppressed nevertheless by means of the second criterion.

Further improvements in the regulating accuracy and utilization of the available operating range result if an adjusting run of the method comprises the following steps: 1. approaching of the surge limit and 2. measuring of state variables at the surge limit which clearly fix the surge limit, and thirdly standardizing of the measured state variables, so that the result is parameters of a standardized or dimensionless representation of the surge limit, which representation is substantially independent of the operating conditions.

If a tighter closeness to the surge limit of a stage is detected, the surge limit regulator regulates at least one of the following three control options:

a) opening of the surge limit regulating valve and/or b) increasing of the rotational speed and/or c) opening of the guide cascade of the inlet guide vane apparatus.

A fourth evaluation module can expediently be provided which evaluates the fluctuation range of the measured values (in particular, the fluctuation range of the inlet pressure and/or the temperature and/or the temperature of the cooling medium) and, as evaluation result, determines a safety number which increases the gap of the regulating line (CL) for the surge limit regulating valve (SLCV) from the surge limit (SL) if the fluctuation range of the measurement increases.

BRIEF DESCRIPTION OF THE DRAWINGS

In the following text, the invention is described using one specific exemplary embodiment with reference to a drawing for improved understanding. In addition to the exemplary illustration, further possible embodiments of the invention which deviate from the example result for a person skilled in the art. In the drawing.

DETAILED DESCRIPTION OF INVENTION

Figure 1:
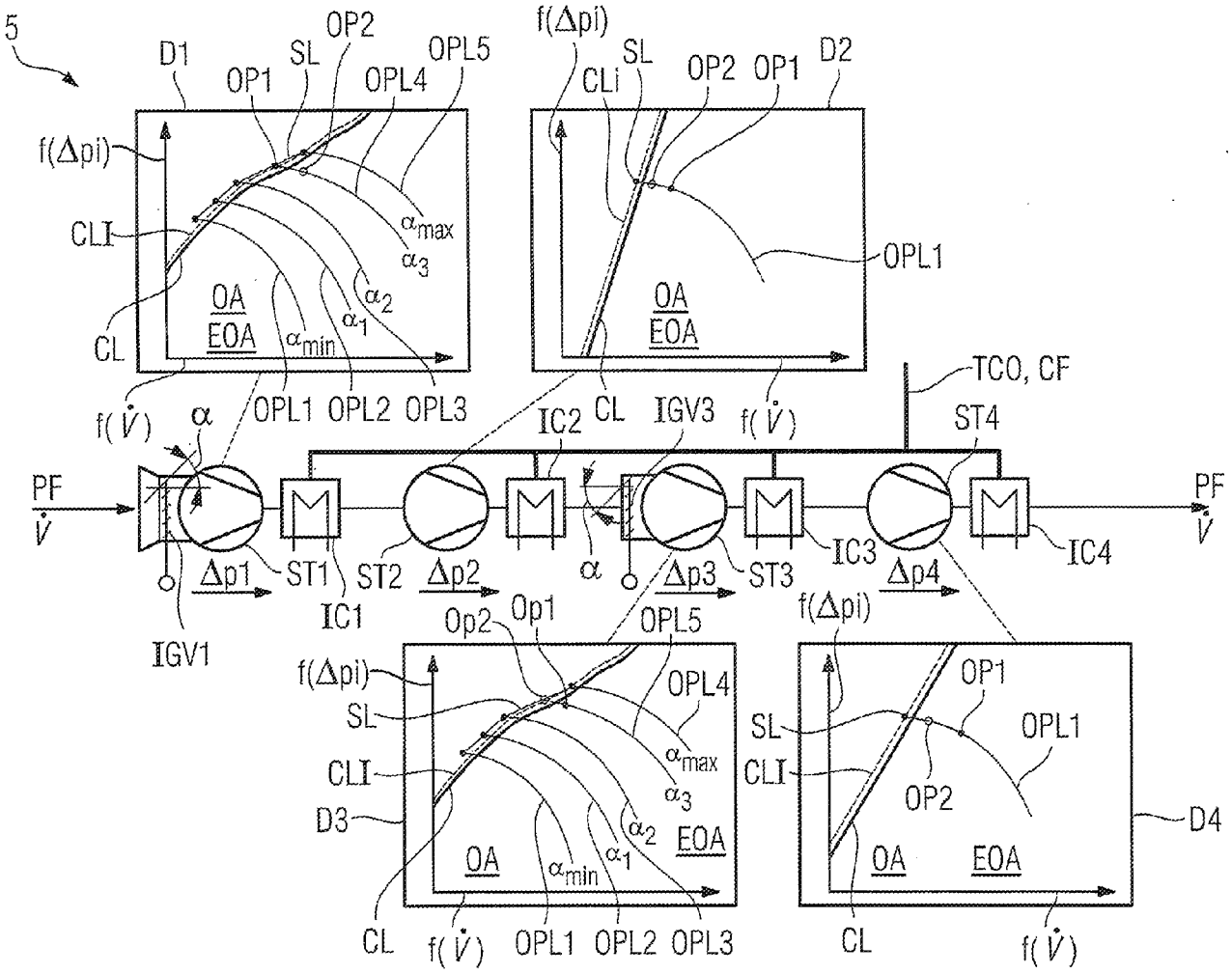
FIG. 1 shows the prior art which has already been described in the introduction.
Figure 2:
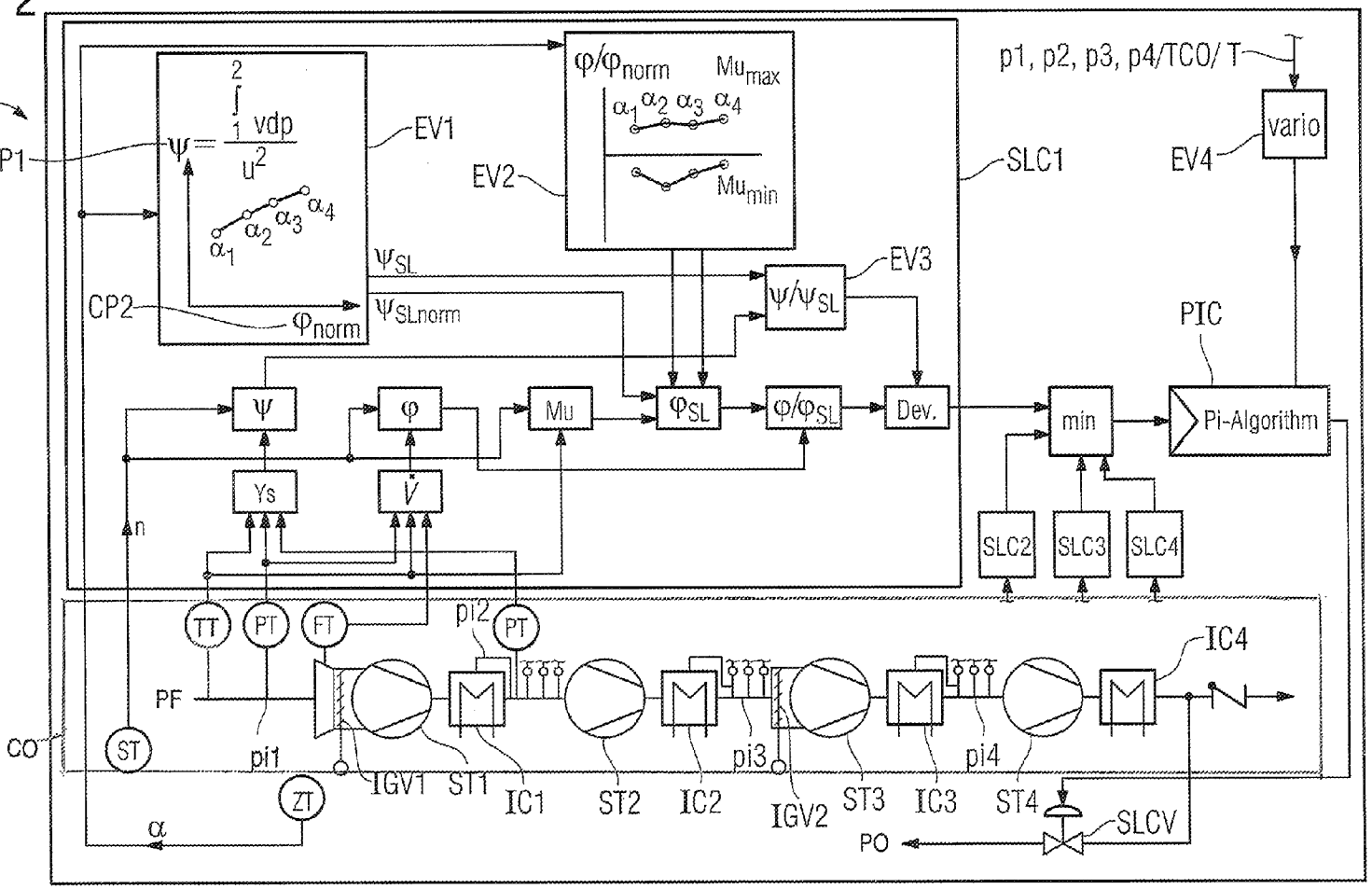
FIG. 2 shows a diagrammatic illustration of one exemplary embodiment of a method according to the invention for operating a multistage turbocompressor.

FIG. 2 shows a diagrammatic illustration of the method according to the invention, applied to a compressor CO with four stages ST1, ST2, ST3, ST4. The designations of FIG. 1 are to be applied to FIG. 2 to denote the same elements (substantially the compressor line which is the subject matter of the invention). At the first stage ST1 and the third stage ST3, the compressor CO in each case has an adjustable inlet guide vane apparatus IGV1, IGV3. An intercooler IC1 to IC4 (the intercooler IC4 of the last stage ST4 is actually an aftercooler, but this distinction is not made in the sequence for reasons of simplification) is provided in each case between the stages ST1 to ST4 and after the last stage ST4.

The compressor CO delivers a process fluid PF, the volumetric flow $\dot{V}$ of which is determined by means of a differential pressure measurement FT. The inlet pressure pi1-pi4 is determined at the inlet of each stage ST1 to ST4 by means of a pressure measurement PT. In addition, the inlet temperature is also determined by means of a temperature measurement TT. The position of the inlet guide vane apparatus IGV1, IGV3 is measured as angle $\alpha$ by means of a position sensor. A surge limit regulating valve SLCV is arranged at the outlet of the compressor CO, which surge limit regulating valve SLCV opens in the case of surging in a manner regulated by a PI regulator, in order to reduce the outlet pressure PO out of the compressor CO. All the measured values which are to be assigned to a stage ST1 to ST4 are transmitted to a surge limit regulator SLC1 to SLC4, each stage ST1 to ST4 in each case being assigned a surge limit regulator SLC1 to SLC4. The output from the surge limit regulator SLC1 to SLC4 is in each case the gap from the surge limit and an evaluation module MIN defines the minimum of said gap which is input into the regulator PIC (which is configured here as a PI regulator) for the surge limit regulating valve SLCV.

By way of example, FIG. 2 shows the surge limit regulator SLC1 for the first stage ST1 in detail.

At the inlet guide vane apparatus IGV1, a position sensor ZT measures the angle $\alpha$ which is converted into two characteristic values CP1, CP2 in a first evaluation EV1. The two characteristic values CP1, CP2 are independent of the operationally dependent influencing variables, such as inlet pressure PI, inlet temperature, rotational speed N and volumetric flow, mass flow and mass throughput of process fluid PF. In the concrete example, this is what is known as the pressure number w or the isentropic flow work, in relation to the square of the circumferential speed on the ordinate, and what is known as the delivery coefficient $\phi$, or the suction-side volumetric flow $\dot{V}$ in relation to the circumferential speed (the remaining unit $m^2$ corresponds to the cross-sectional area of the inflow which is to be assumed to be constant). The pressure number $\psi$ is denoted as $\psi$ in the evaluation EV1 in the diagram and the delivery coefficient is denoted as $\phi$-Norm. The pressure number of the surge limit SL and the associated standardized delivery coefficient $\phi$SL-Norm are determined with the input of the angle $\alpha$ into the first evaluation EV1. Since the delivery coefficient $\phi$SL-Norm still has a certain dependency on the circumferential Mach number at the surge limit, a precision correction EV2 can be provided, as shown in the exemplary embodiment, in which precision correction EV2 the ratio $\phi$ to $\phi$-Norm is determined for a minimum possible circumferential Mach number $Mu_{Min}$ and the maximum of the circumferential Mach number $Mu_{Max}$.

From the measured values at the inlet of the first stage ST1 for temperature and pressure PI and at the outlet of the first stage ST1 after the first intercooler IC1, the output pressure PO determines the isentropic delivery head YS which, combined with the measured value for the rotational speed N, results in the actually present isentropic pressure number $\psi$.

In a similar way, the actually present delivery coefficient is determined from the rotational speed and the volumetric flow $\dot{V}$. Finally, the surge limit delivery coefficient $\phi$SL and the surge limit pressure number $\psi$SL are provided by way of the values from the evaluation EV1 and the precision correction EV2; said surge limit delivery coefficient $\phi$SL, and surge limit pressure number $\psi$SL are related to the actual delivery coefficient $\phi$ and pressure number $\psi$, a third evaluation EV3 selecting from said two quotients that one which specifies a tighter closeness to the surge limit and transmits it to the evaluation module Min to determine the most critical stage ST1, ST2, ST3, ST4. In the described way, said evaluation module transmits the value of the most critical stage (ST1 to ST4) to the pump position regulator PIC of the surge limit regulating valve SLCV.

As is shown in FIG. 1, each stage ST1 to ST4 can be assigned a dedicated regulating line CL which delimits an operating range OA, in which the compressor CO is operated without surging, at a gap on this side from the surge limit SL. It is also shown in FIG. 1 that each stage ST1 to ST4 can be assigned a control line CLI for controlling the opening of the surge limit regulating valve SLCV, which control line CLI delimits an extended operating range EOA, in which the compressor CO is operated without surging, at a gap on this side from the surge limit SL.

In the representation of FIG. 2, a fourth evaluation module (EV4) is provided which evaluates the fluctuation range (vario) of the measured values, and determines as evaluation result a safety number which increases the gap of the regulating line (CL) for the surge limit regulating valve (SLCV) from the surge limit (SL) if the fluctuation range of the measurement increases.

The invention claimed is:

1. A method for operating a multistage compressor with a monitoring means for reaching of the surge limit or a defined gap from the surge limit, comprising:

measuring a first measured variable at an inlet of each stage of the compressor;

providing a surge limit regulator assigned to each stage comprising an evaluation module which surge limit regulator monitors each respective stage separately for the reaching of the surge limit or a defined gap from the surge limit using a reference variable which is specific for the stage;

comparing the reference variable, specific for each stage, with the stage-specific first measured variable using the surge limit regulator; and determining a state of the surging when a defined gap from the surge limit is reached, wherein the reference variable is characteristic of reaching the surge limit or the defined gap from the surge limit, measuring a rotational speed and/or the angle of attack of an inlet guide vane apparatus;

determining the surge limit for each stage as at least one standardized characteristic variable which is called up from an internal memory independently of an inlet pressure and/or an inlet temperature and/or a volumetric flow and/or a mass throughput and/or a longitudinal flow;

measuring the inlet pressure and/or the inlet temperature and/or the volumetric flow and/or the mass throughput and/or the mass flow;

determining the surge limit for each stage and each standardized characteristic variable using the measurements for an operating point; and determining the surge limit from the standardized characteristic variable for each stage which affords the greatest operating range, and fixing the surge limit of each stage by a surge limit regulator as criterion which is closest to the current operating point.

* * * * *